US010004372B2

(12) United States Patent
Escobar et al.

(10) Patent No.: US 10,004,372 B2
(45) Date of Patent: Jun. 26, 2018

(54) MOP WITH REMOVABLE SECONDARY CLEANING HEAD

(71) Applicant: Helen of Troy Limited, Belleville, St. Michael (BB)

(72) Inventors: Juan Carlos Escobar, Brooklyn, NY (US); David Colie Wight, West Orange, NJ (US); Claire Afton Dunnington, Brooklyn, NY (US); Vicente Jorge Valderrama, Staten Island, NY (US); Heidi Serene Farrell, Brooklyn, NY (US); Reid Schlegel, Oradell, NJ (US); Anthony Bevin Mallier, Brooklyn, NY (US)

(73) Assignee: Helen of Troy Limited, Belleville, St. Michael (BB)

( * ) Notice: Subject to any disclaimer, the term of this patent is extended or adjusted under 35 U.S.C. 154(b) by 677 days.

(21) Appl. No.: 14/600,147

(22) Filed: Jan. 20, 2015

(65) Prior Publication Data

US 2015/0201820 A1 Jul. 23, 2015

Related U.S. Application Data

(60) Provisional application No. 61/930,038, filed on Jan. 22, 2014.

(51) Int. Cl.
*A47L 13/24* (2006.01)
*A47L 13/254* (2006.01)
(Continued)

(52) U.S. Cl.
CPC ..... *A47L 13/12* (2013.01); *A47L 13/22* (2013.01); *A47L 13/254* (2013.01); *A47L 13/256* (2013.01)

(58) Field of Classification Search
CPC ..... A47L 13/12; A47L 13/254; A47L 13/256
(Continued)

(56) References Cited

U.S. PATENT DOCUMENTS

| | | | |
|---|---|---|---|
| 937,007 | A | 10/1909 | McLaughlin |
| 2,834,036 | A | 5/1958 | Shannon |

(Continued)

FOREIGN PATENT DOCUMENTS

| | | |
|---|---|---|
| CN | 2358828 | 1/2000 |
| CN | 2534958 | 2/2003 |

(Continued)

OTHER PUBLICATIONS

International Search Report filed in PCT/US2015/011938 dated May 4, 2015.

(Continued)

*Primary Examiner* — Michael Jennings
(74) *Attorney, Agent, or Firm* — Rankin, Hill & Clark LLP

(57) ABSTRACT

A mop includes a mop head, a secondary cleaning head and a handle. The mop head includes a secondary cleaning head chamber and a first attachment element. The secondary cleaning head is selectively receivable in the secondary cleaning head chamber and includes a second attachment element that cooperates with the first attachment element to selectively connect the secondary cleaning head with the mop head. The handle connects with the secondary cleaning head and is operatively connectable to the mop head. The handle is connected with the mop head when the secondary cleaning head is received in the secondary cleaning head chamber and the second attachment element is engaged with the first attachment element, and the handle is disconnected with the mop head when the secondary cleaning head is not received in the secondary cleaning head chamber.

15 Claims, 9 Drawing Sheets

(51) Int. Cl.
*A47L 13/12* (2006.01)
*A47L 13/256* (2006.01)
*A47L 13/22* (2006.01)

(58) Field of Classification Search
USPC ..... 15/147.1, 147.2, 228
See application file for complete search history.

(56) References Cited

U.S. PATENT DOCUMENTS

| | | | | |
|---|---|---|---|---|
| 2,858,559 | A * | 11/1958 | Carlson, Sr. | A47L 13/44 15/247 |
| 3,157,901 | A | 11/1964 | Murphy | |
| 5,488,750 | A | 2/1996 | Vosbikian et al. | |
| 6,058,548 | A * | 5/2000 | Footer | A47L 13/12 15/119.2 |
| 6,178,581 | B1 | 1/2001 | Lewis | |
| 6,419,415 | B1 * | 7/2002 | Vosbikian | A46B 11/06 401/137 |
| 7,856,691 | B2 | 12/2010 | Viggiani | |
| 8,069,520 | B2 | 12/2011 | Mattucci et al. | |
| 8,166,597 | B2 * | 5/2012 | Levitt | A47L 13/12 15/118 |
| 8,495,781 | B2 * | 7/2013 | Dingert | A47L 11/22 15/320 |
| 8,533,890 | B2 | 9/2013 | Pannell | |
| 8,990,998 | B1 * | 3/2015 | McBride, Jr. | A47L 13/22 15/104.94 |
| 2008/0052851 | A1 | 3/2008 | Lin | |
| 2010/0139558 | A1 * | 6/2010 | Viggiani | B05C 1/06 118/255 |
| 2010/0205758 | A1 | 8/2010 | Levitt | |
| 2011/0185529 | A1 * | 8/2011 | Kandasamy | A47L 13/10 15/209.1 |
| 2011/0225754 | A1 * | 9/2011 | Weis | A47L 13/12 15/143.1 |

FOREIGN PATENT DOCUMENTS

| | | |
|---|---|---|
| CN | 201189144 | 2/2009 |
| CN | 202619591 | 12/2012 |
| CN | 203341665 | 12/2013 |
| JP | 62-030762 | 2/1987 |
| JP | 10-314093 | 12/1998 |
| JP | 2004329601 | 11/2004 |
| JP | 2010-234026 | 10/2010 |
| JP | 3167156 | 4/2011 |
| JP | 2011115285 | 6/2011 |
| JP | 2013-066628 | 4/2013 |
| KR | 2006129999 | 12/2006 |
| WO | 2008/124341 | 10/2008 |
| WO | 2012/130123 | 10/2012 |

OTHER PUBLICATIONS

Supplementary European Search Report filed in EP 15 74 0468 dated Mar. 7, 2018.

* cited by examiner

MOP WITH REMOVABLE SECONDARY CLEANING HEAD

BACKGROUND

When cleaning floors or other surfaces, a large mop head is useful to cover as much area as possible. Known mop heads can carry a large primary cleaning element, such as microfiber or similar material, and operate as a dry mop for dusting or a wet mop for more thorough cleaning. While cleaning, there are commonly stubborn stains or marks that require more pressure or a more abrasive cleaning element to get out than would be possible with the standard large primary cleaning element. This can occur when wet mopping and dry floor dusting.

There are existing mops that include more abrasive scrubbing implements. A very common implementation of a mop and a more abrasive scrubbing implement is one in which a small scrubbing element mounts onto the front or side of the mop head. Such a mop usually requires flipping the mop head over or positioning the mop head in a position other than the position used for regular mopping. Often the larger mop head prevents the operator from seeing the scrubbing surface or the stain when being used or the larger mop head gets in the way of scrubbing in a small area or when the stain is near a piece of furniture or a wall. This repositioning of the mop head to use the scrubbing element can be awkward or the angle of handle pole required to use the scrubbing element can be awkward making the scrubbing element difficult to use.

SUMMARY

In view of the foregoing, a mop includes a mop head, a secondary cleaning head and a handle. The mop head includes a secondary cleaning head chamber and a first attachment element. The secondary cleaning head is selectively receivable in the secondary cleaning head chamber and includes a second attachment element that cooperates with the first attachment element to selectively connect the secondary cleaning head with the mop head. The handle connects with the secondary cleaning head and is operatively connectable to the mop head. The handle is connected with the mop head when the secondary cleaning head is received in the secondary cleaning head chamber and the second attachment element is engaged with the first attachment element, and the handle is disconnected with the mop head when the secondary cleaning head is not received in the secondary cleaning head chamber.

DETAILED DESCRIPTION

Figure 1:
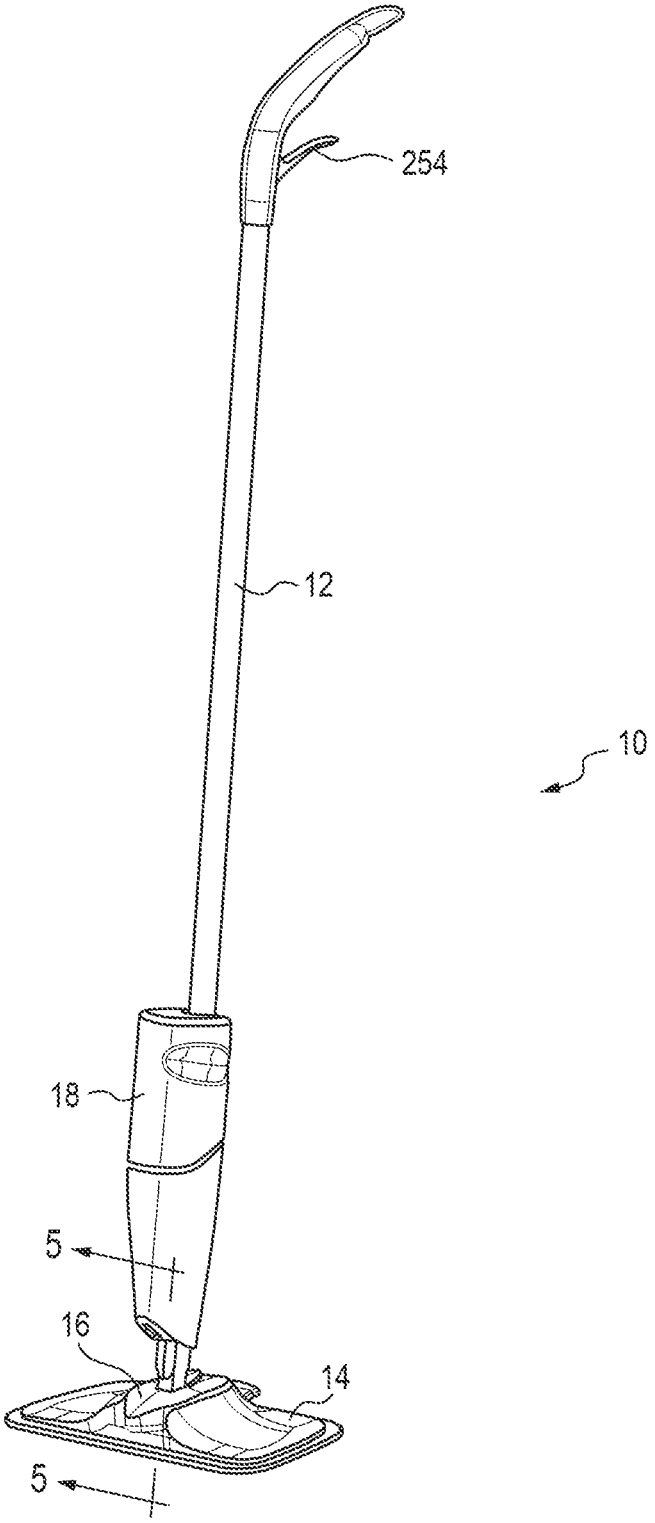
FIG. 1 is a perspective view of the front of a mop with a removable secondary cleaning head.
Figure 2:
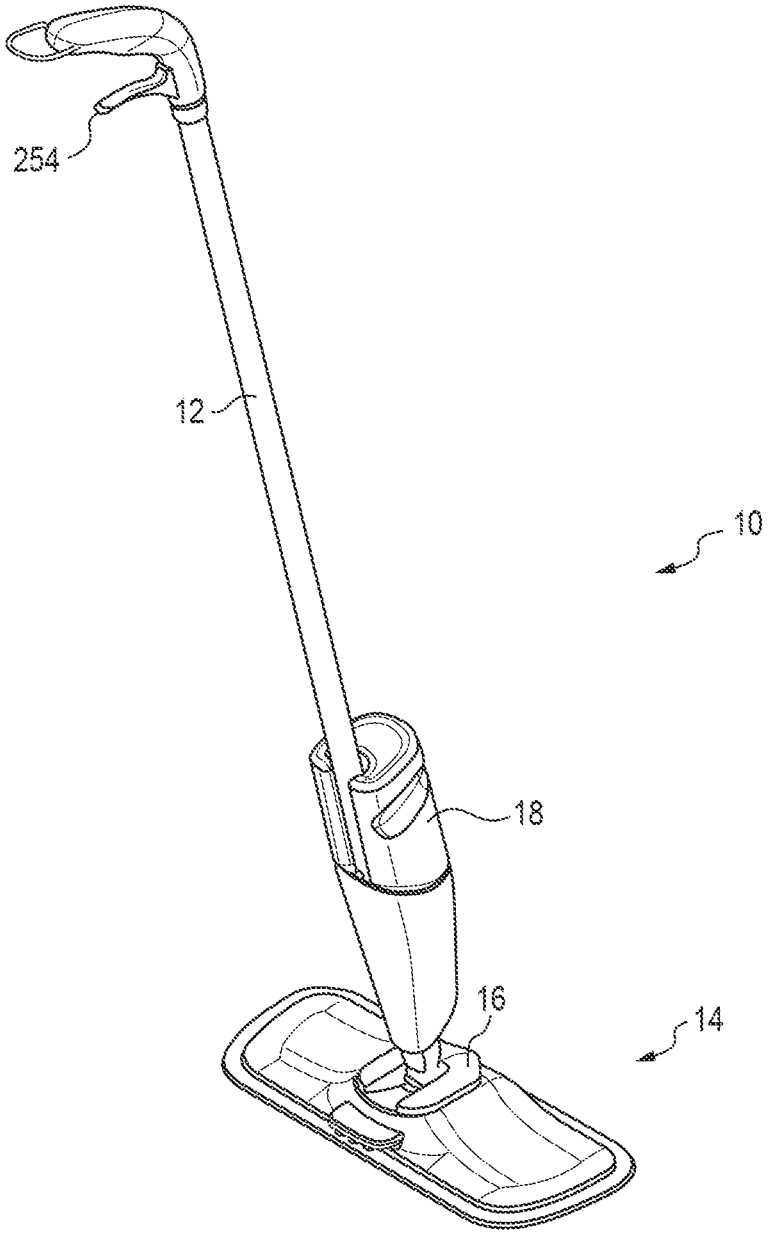
FIG. 2 is a perspective view of the rear of the mop shown in FIG. 1.
Figure 3:
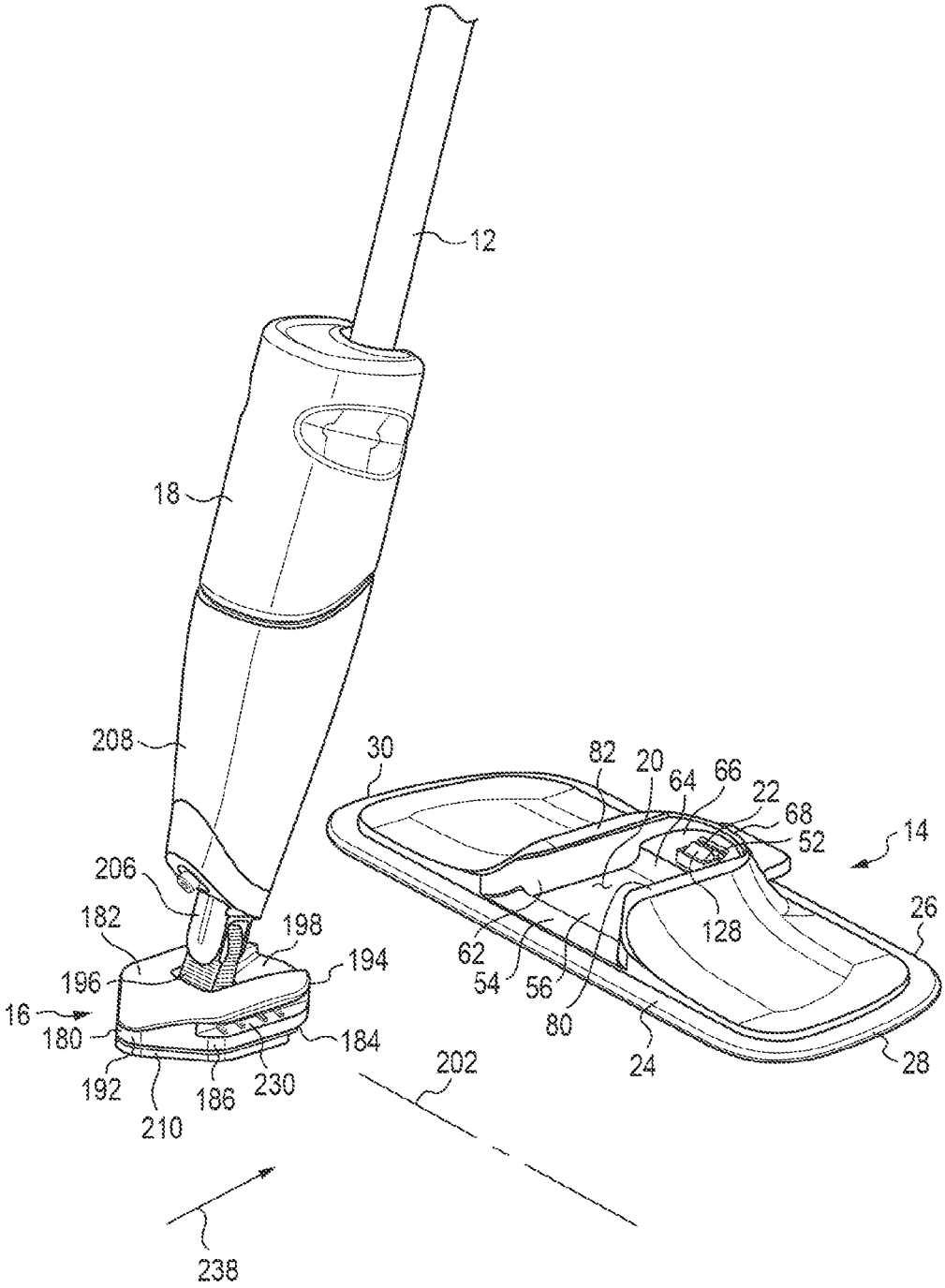
FIG. 3 is a perspective view of the mop shown in FIG. 1 with the secondary cleaning head removed from a mop head.

FIGS. 1 and 2 depict a mop 10 including a handle 12, a mop head 14, and a secondary cleaning head 16. The handle 12 operatively connects with the mop head 14 through the secondary cleaning head 16. The mop 10 can be either a wet mop or a dry mop. A reservoir 18 containing cleaning fluid can be carried by the handle 12 so that the mop 10 could operate as a wet mop. The secondary cleaning head 16 is removable from the mop head 14, as depicted in FIG. 3, so that the secondary cleaning head 16 can be used, for example, on tough stains and the like. As illustrated, the secondary cleaning head 16 is also smaller than the mop head 14 so that the secondary cleaning head 16 can be used to clean smaller areas that cannot be reached with the mop head 16. The mop head 14 includes a secondary cleaning head chamber 20 where the secondary cleaning head 16 resides when connected with the mop head 14. A first attachment element, which in the illustrated embodiment is a spring-loaded latch 22, on the mop head 14 engages with and can be disengaged from the secondary cleaning head 16 to connect and disconnect the secondary cleaning head with the mop head 14. Other types of attachment elements could be used.

In the illustrated embodiment, the handle 12 is configured as an elongated pole, however, the handle could be shorter. For example, the handle 12 may be shorter where the mop head 14 is smaller to provide a smaller hand-held mop having a removable scrubbing element.

With continued reference to FIG. 3, the mop head 14 has a generally rectangular footprint. The mop head 14, however, could be a number of different shapes. The mop head 14 as illustrated includes a leading edge 24, a trailing edge 26, a left edge 28, and a right edge 30 per the orientation depicted in FIG. 3. The directional terms used to describe the edges are for ease of understanding the drawings, and should not be taken to limit the mop head 14 to any particular orientation. The secondary cleaning head chamber 20 is open at the leading edge 24 to allow the secondary cleaning head 16 to be moved, for example slid, with respect to the mop head 14 toward the trailing edge 26 to connect the secondary cleaning head 16 with the mop head 14. The secondary cleaning head chamber 20 is also open at the leading edge 24 to allow the secondary cleaning head 16 to be moved, for example slid, with respect to the mop head 14 over the leading edge 24 and away from the trailing edge 26 when the latch 22 is not engaged with the secondary cleaning head 16.

Figure 4:
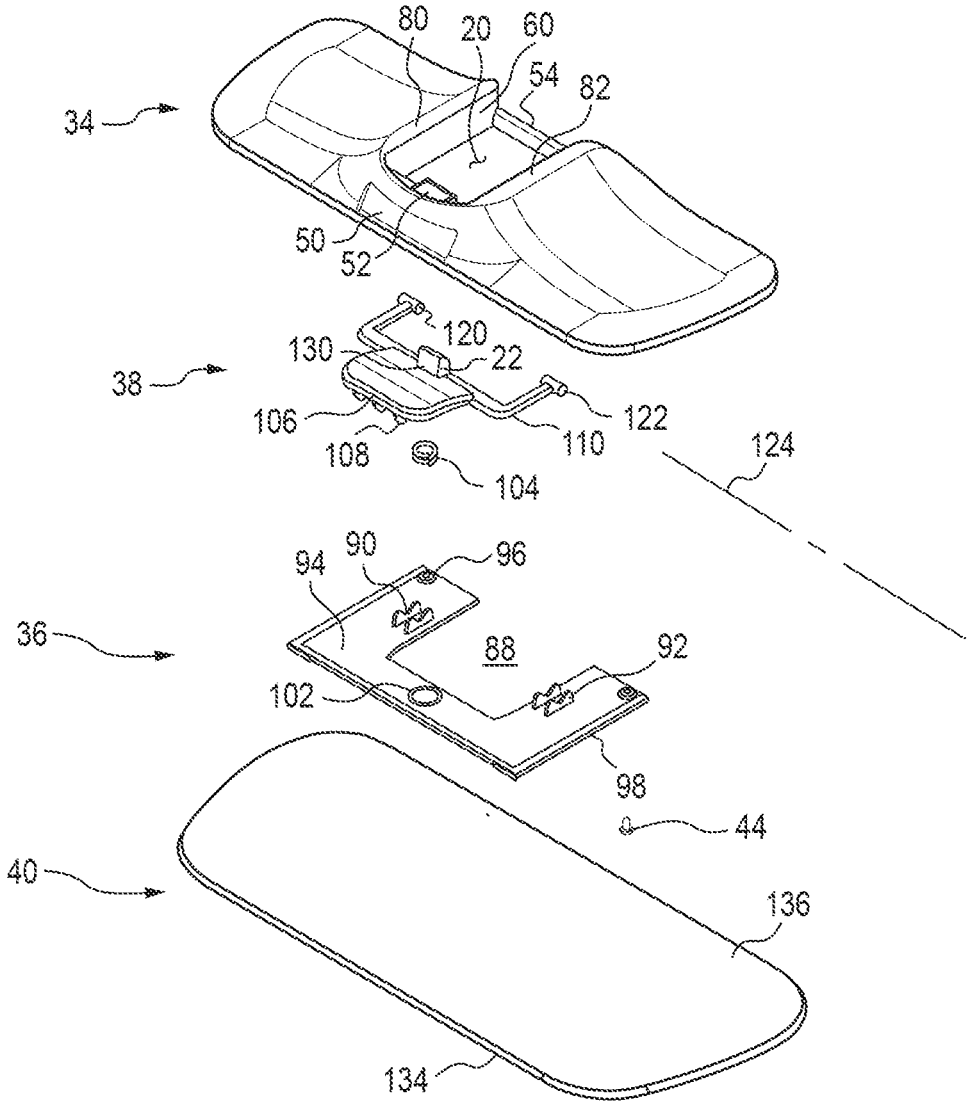
FIG. 4 is an exploded view of the mop head.

With reference to FIG. 4, the mop head 14 includes a housing, which in the illustrated embodiment is made up of an upper housing section 34 and a lower housing section 36. The mop head 14 also includes a pedal 38 and a cleaning pad 40, which can operate as the primary cleaning element for the mop 10. The upper housing section 34 connects with the lower housing section 36 using fasteners 44 (only one visible in FIG. 4). The upper housing section 34 can connect with the lower housing section 36 in other conventional manners. The pedal 38 is disposed between the upper housing section 34 and the lower housing section 36. The cleaning pad 40 selectively connects with the lower housing section 36 and/or the upper housing section 34. The cleaning pad 40 can be removed so as to be cleaned or replaced.

The housing 34, 36 defines the secondary cleaning head chamber 20. With reference to FIG. 4, the housing 34, 36 includes an actuator opening 50 and a latch opening 52, both of which are provided in the upper housing section 34 in the illustrated embodiment. The latch opening 52 is positioned in a rear section of the secondary cleaning head chamber 20. The actuator opening 50 is positioned rearward from the secondary cleaning head chamber 20 and is positioned near the trailing edge 26 of the mop head 14.

Figure 5:
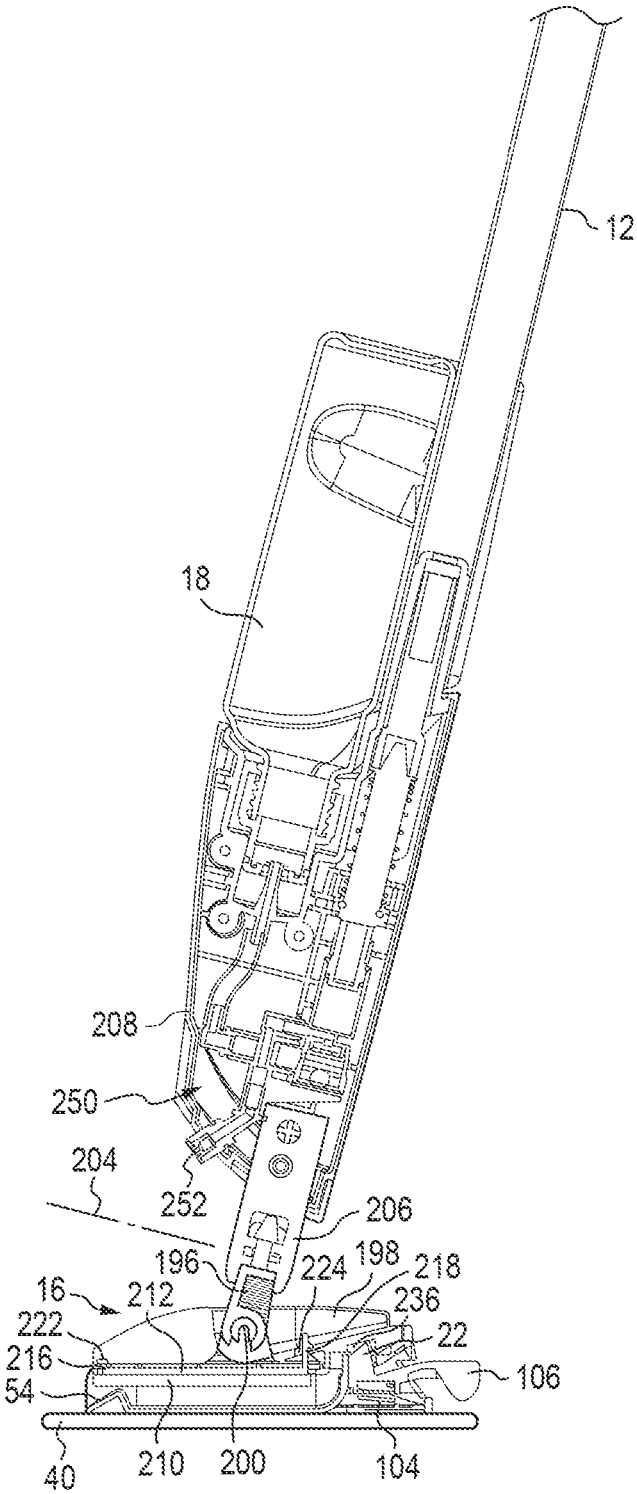
FIG. 5 is a cross-sectional view taken through line 5-5 in FIG. 1.

The housing 34, 36 of the mop head 14 also includes a ramp 54 that is angled upwardly away from the surface to be cleaned by the mop 10 and toward the secondary cleaning head chamber 20 when the mop head 14 is on the surface to be cleaned in an operating position such as that shown in FIG. 5. The ramp 54 is inclined upwardly from the leading edge 24 toward the trailing edge 26 and into the secondary cleaning head chamber 20. In the illustrated embodiment, the ramp 54 is formed as a part of the upper housing section 34. The housing 34, 36 also includes a secondary cleaning head chamber floor 56. In the illustrated embodiment, the secondary cleaning head chamber floor 56 is flat (planar) and positioned rearward of the ramp 54 and below an upper edge of the ramp. Secondary cleaning head chamber sidewalls 60, 62 extend upwardly from the secondary cleaning head chamber floor 56 to further define the secondary cleaning head chamber 20. The secondary cleaning head chamber sidewalls 60, 62 are disposed on opposite sides of the secondary cleaning head chamber floor 56, i.e., the left secondary cleaning head chamber sidewall 60 extends upwardly from the left side of the secondary cleaning head chamber floor 56 and the right secondary cleaning head chamber sidewall 62 extends upwardly from the right side of the secondary cleaning head chamber floor 56. The secondary cleaning head chamber sidewalls 60, 62 are parallel with one another and are planar and disposed in a vertical plane when the mop head 14 is on the surface to be cleaned in an operating position. A curved rear wall 64 provides a transition between the secondary cleaning head chamber floor 56 and a ledge 66 in which the latch opening 52 is provided. The ledge 66 slopes upwardly away from the ramp 54 and rearwardly towards the trailing edge 26. The curved upper rear wall 68 extends upwardly from the ledge 66 to define a rear wall of the secondary cleaning head chamber 20.

The mop head 14 also includes a track that cooperates with the secondary cleaning head 16 to appropriately orient the secondary cleaning head 16 within the secondary cleaning head chamber 20. The track can also facilitate the connection between the secondary cleaning head 16 and the mop head 14. In the illustrated embodiment, the mop head housing 34, 36 includes a left track 80 and a right track 82. The left track 80 extends inwardly into the secondary cleaning head chamber 20 from the left secondary cleaning head chamber side wall 60, and the right track 82 extends inwardly into the secondary cleaning head chamber 18 from the right secondary cleaning head chamber side wall 62. In the illustrated embodiment, the tracks 80, 82 are formed as part of the upper housing section 34 and are positioned at the upper edge of the respective secondary cleaning head chamber side walls 60, 62. The tracks 80, 82 flare outwardly at each end adjacent the leading edge 24, which can aid in locating the secondary cleaning head 16 inside the secondary cleaning head chamber 20. The tracks 80, 82 reside in the same plane and are horizontally oriented.

In the illustrated embodiment, the lower housing section 36 is a plate that is one integrally formed, e.g., molded, plastic piece. The lower housing section 36 is generally rectangular in plan view and includes a notch 88 that is generally aligned with and disposed beneath the secondary cleaning head chamber 20 when the lower section 36 is connected with the upper section 34. Left axle supports 90 and right axle supports 92 extend upwardly from an upper surface 94, which is planar, toward the upper housing section 34. Fastener openings 96 extend through the lower housing section 36 from a lower surface 98 to the upper surface 94. The fastener openings 96 receive the fasteners 44 to connect the lower housing section 36 with the upper housing section 34. The lower housing section 36 also includes a spring retaining boss 102 that extends upwardly from the upper surface 94 toward the upper housing section 34. The spring retaining boss 102 in the illustrated embodiment is circular.

With reference to FIG. 4, the mop head 14 includes a latching mechanism, which includes the pedal 38 and a spring 104. The latching mechanism also includes the first attachment element 22, which as illustrated is a ramped element that engages the secondary cleaning head 16 to retain the secondary cleaning head 16 within the secondary cleaning head chamber 20.

With reference back to FIG. 3, the pedal 38 is an integrally formed, e.g., molded, piece of plastic including the first attachment element 22 and an actuator, which is a pad 106 in the illustrated embodiment. The actuator pad 106 is positioned on the mop head 14 so that the actuator pad 106 can be stepped on by an operator to unlatch the secondary cleaning head 16 from the first attachment element 22 so that the secondary cleaning head 16 can be slid out from the secondary cleaning head chamber 20 and disconnected from the mop head 14. The actuator pad 106 need only be depressed to unlatch the secondary cleaning head 16 from the mop head 14, and need not be stepped on. The actuator pad 106 is generally square in plan view and is shaped to extend through the actuator pad opening 50 provided in the upper housing section 34. The actuator pad 106 is exposed through the actuator pad opening 50 so as to be accessible by an operator of the mop 10 during a mopping operation. Ridges 108 can be provided on a lower side of the actuator pad 106 to limit travel of the actuator pad 106 when being stepped on by an operator.

The pedal 38 further includes a connecting appendage 110 that spans and connects a left axle 120 with a right axle 122. The connecting appendage 110 connects with a forward edge of the actuator pad 106. The connecting appendage 110 is U-shaped in plan view. The left axle 120 is received in the left axle supports 90 on the lower housing section 36. The right axle 122 is received in the right axle supports 92 also on the lower housing section 36. The left axle 120 is coaxial with the right axle 122. The pedal 38 pivots about a pivot axis 124 defined by the axles 120, 122 with respect to the upper housing section 34 and the lower housing section 36.

The first attachment element 22 is located centrally between the left axle 120 and the right axle 122. The first attachment element 22 is positioned on the forward edge of the actuator pad 106 and extends upwardly from the actuator pad. As described above, the first attachment element 22 is in the shape of a ramped bump having a ramped leading surface 128 (FIG. 3) and a more vertical trailing surface 130 (FIG. 4). The ramp leading surface 128 is ramped upwardly and towards the rear (towards the trailing edge 26) and is more horizontally sloped than the trailing surface 130.

The spring 104 acts against the lower housing section 36 and the actuator pad 106 to pivot the pedal 38 in a general upward direction about the pivot axis 124. The spring 104 biases the first attachment element 22 through the latch opening 52 in the upper housing section 34. Since the first attachment element 22 is connected with the actuator pad 106, when an operator presses down on the actuator pad 106 moving the actuator pad 106 downwardly with respect to the housing 34, 36, the first attachment element 22 also moves downwardly with respect to the housing 34, 36.

The cleaning pad 40 includes a lower surface 134 that is in contact with the surface that is to be cleaned and an upper surface 136 that is opposite the lower surface. The cleaning pad 40 can attach with the lower housing section 36 and/or the upper housing section 34 in any conventional manner. The cleaning pad 40 can be similar to a conventional cleaning pad.

Figure 7:
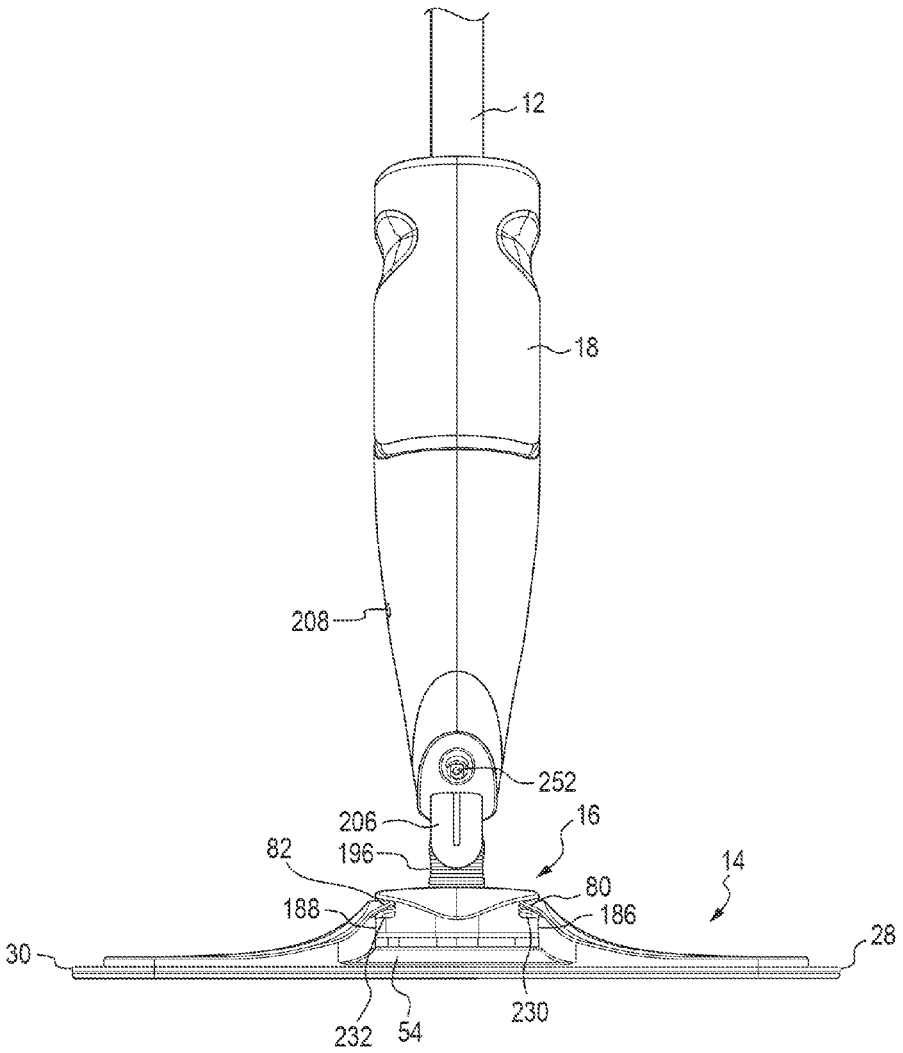
FIG. 7 is a front view of the mop depicted in FIG. 1.

With reference to FIG. 3, the secondary cleaning head 16 includes a body 180 having an upper surface 182 and a lower surface 184. The upper surface 182 and the lower surface 184 are generally horizontally oriented when the mop 10 is in use cleaning a floor. The body 180 also includes a left side 186 and a right side 188 (FIG. 7), each of which are generally vertically oriented when the mop 10 is in use cleaning a floor. The body 180 further includes a leading side 192 and a trailing side 194.

With reference to FIG. 3, a handle connector 196 connects with the body 180 and is received in a recess 198 provided in the upper surface 182 of the body 180 at a rear section of the body. The handle connector 196 connects with an axle 200 (FIG. 5) on the body 180, which allows for rotation of the handle 12 with respect to the secondary cleaning head 16 about a first rotational axis 202. Because of the connection between the handle 12 and the secondary cleaning head 16, the handle 12 can rotate about a second rotational axis 204, which is perpendicular to the first rotational axis 202, with respect to the secondary cleaning head 16. A connector 206, which is operatively connected with the handle 12 through a pump housing 208, connects with the handle connector 196 so that the handle 12 can rotate about the second rotational axis 204 with respect to the secondary cleaning head 16.

Figure 6:
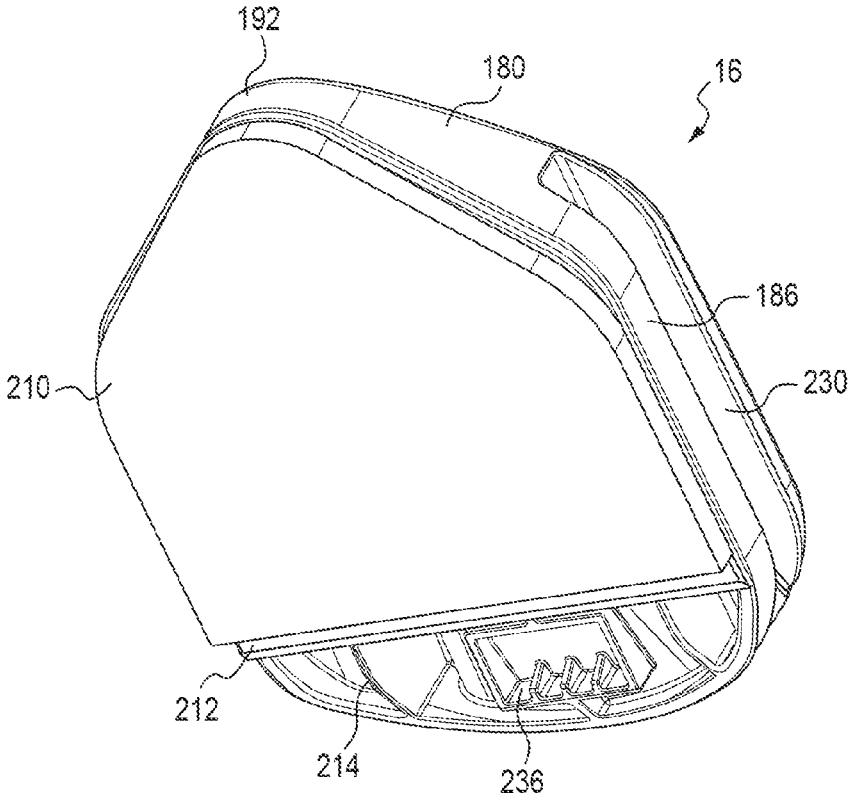
FIG. 6 is a perspective view showing a lower surface of the secondary cleaning head.

The secondary cleaning head 16 can also include a scrubbing pad 210 that releaseably connects with the body 180. The scrubbing pad 210 is made of a material that can be more abrasive than the cleaning pad 40 and can operate as the secondary cleaning element for the mop 10. Alternatively, the scrubbing pad 210 can be made from a material that is similar to the cleaning pad 40, but due to the smaller size of the scrubbing pad 210, the scrubbing pad can be useful in cleaning areas that are too small for the cleaning pad 40 to reach into. The scrubbing pad 210 is connected with a carrier 212 that contacts the lower surface 184 of the body 180 while leaving a chamfered rear section 212 of the lower surface 184 exposed (see FIG. 6). The carrier 212 can be made from a rigid plastic material and include a forward tab 216 and a rear barb 218 that can flex or bend. The forward tab 216 is received in a channel 222 provided in the lower surface 184 of the body 180 and the rear barb extends through an opening 224 in the body 180 and engages the body 180 to connect the carrier 212 and the scrubbing pad 210 affixed thereto to the body 180. The scrubbing pad 210 can be removed from the body 180 by flexing the rear barb 218 away from engagement with the body 180.

The secondary cleaning head 16 also includes slots 230 and 232 that cooperate with the tracks 80, 82 on the mop head 14. A left slot 230 is configured to receive the left track 80 and a right slot 232 (FIG. 7) is configured to receive the right track 82 when the secondary cleaning head 16 is received in the secondary cleaning head chamber 20 and latched with the mop head 14. Each of the slots 230, 232 extends entirely through the respective sides 186, 188 from the leading side 192 through to the trailing side 194. As illustrated, the slots 230, 232 are located nearer the upper surface 182 as compared to the lower surface 184 of the body 180. The slots 230, 232 and the tracks 80, 82 are located so that the scrubbing pad 210 is spaced from the secondary cleaning head chamber floor 56 (FIG. 3) or from the upper surface 136 of the cleaning pad 40 when the cleaning pad is connected with the mop head 14. This is more clearly visible in FIGS. 5 and 7. Spacing the scrubbing pad 210 from the secondary cleaning head chamber floor 56 or from the cleaning pad 40 allows ambient air to enter into the secondary cleaning head chamber 20, which can allow the scrubbing pad 210 to dry more easily.

The secondary cleaning head 16 also includes a second attachment element that cooperates with the first attachment element 22 on the mop head 14. As illustrated, the second attachment element for the secondary cleaning head 16 is an opening or recess 236 provided in the chamfered rear section 214 of the lower surface 184 of the body 180. As shown in FIG. 5, the opening or recess 236 is configured to receive the first attachment element 22 on the pedal 38 to connect the secondary cleaning head 16 with the mop head 14. Since the pedal 38 is biased upwardly by the spring 104, as the chamfered rear section 214 contacts the ramped leading surface 128 of the first attachment element 22, the first attachment element 22 is moved downwardly until the first attachment element 22 is received in the opening or recess 236 on the secondary cleaning head 16. At this time the pedal 38 pivots upwardly due to the biasing force of the spring 106, which attaches the secondary cleaning head 16 with the mop head 14. An operator can depress the actuator pad 106 to disengage the secondary cleaning head 16 from the mop head 14. Pushing the actuator pad 106 downward results in the first attachment element 22 moving downwardly and out of the latch opening 56 in the housing 34, 36 and out of the opening or recess 236 in the secondary cleaning head 16. At this time the secondary cleaning head 16 can be moved, e.g., slid, forwardly over the leading edge 24 of the mop head 14 and slid out from the secondary cleaning head chamber 20. To reattach the secondary cleaning head 16 with the mop head 14, the secondary cleaning head 16 is moved in a direction of arrow 238 in FIG. 3. The chamfered rear section 214 on the lower surface 184 of the body 180 contacts the ramp 54 at the leading edge 24 of the mop head 14. The secondary cleaning head chamber side walls 60 and 62 can contact the sides 186 and 188 of the body 180 and the slots 230, 232 can receive the respective tracks 80, 82. The secondary cleaning head 16 is continued to be pulled or moved in the direction of arrow 238 until the chamfered rear section 214 of the lower surface 184 of the body 180 contacts the ramped leading surface 128 of the first attachment element 22, which moves the first attachment element 22 downwardly against the biasing force of the spring 104. When the first attachment element 22 is received in the opening or recess 236 on the secondary cleaning head 16, the spring 104 biases the pedal 38 upwardly so as to rotate the pedal 38 about the rotational axis 124 such that the first attachment element 22 is engaged with the body inside the opening or recess 230.

With reference to FIG. 5, the mop 10 can include a pump assembly 250 in the pump housing 208. The pump assembly 250 pumps cleaning fluid from the reservoir 18 to an outlet 252 provided on the pump housing 208. The pump assembly 250 is operated when an operator squeezes a trigger 254 (FIG. 1) to spray cleaning fluid on the surface to be cleaned through the outlet 252. The pump assembly 250 can be mechanically or electrically actuated when the trigger 254 is squeezed.

In the illustrated embodiment above, the first attachment element 22 is movable with respect to the housing 34, 36 of the mop head 14 and the second attachment element on the secondary cleaning head 16 is fixed, or not movable, with respect to the body 180 of the secondary cleaning head 16. In an alternative arrangement, the attachment element on the mop head could be immovable with respect to the housing 34, 36 and the attachment element of the secondary cleaning head 16 could be a movable element. Likewise, the body 180 of the secondary cleaning head 16 is shown to include slots 230, 232 and the mop head 14 is shown to include tracks 80, 82 received in the slots. In an alternative arrangement, the body 180 of the secondary cleaning head 16 could include at least one track, similar to at least one of the tracks 80, 82, and the mop head 14 could include at least one slot, similar to at least one of the slots 230, 232, to allow for a slidable connection between the mop head 14 and the secondary cleaning head 16. Also, the tracks 80, 82 and the slots 230, 232 are horizontally oriented (with the mop 10 in the operating position); however, the secondary cleaning head 16 and the mop head 14 could be designed so that the secondary cleaning head connects with the mop head by moving the secondary cleaning head in a vertical direction with respect to the mop head. In this embodiment, at least one track, which could be provided on the secondary cleaning head or the mop head, would cooperate with at least one slot, which could be provided on whichever of the secondary cleaning head or the mop head that does not have the track, and both the track and the slot would be vertically oriented. As just one example, vertical ribs could be provided on sides of the secondary cleaning head chamber in the mop head, and the secondary cleaning head would include slots to receive the ribs. Additionally, the first attachment element 22 could be reconfigured for horizontal (in contrast to the vertical pivotal movement in the illustrated embodiment) through a known linkage connected with the pedal 38.

Figure 8:
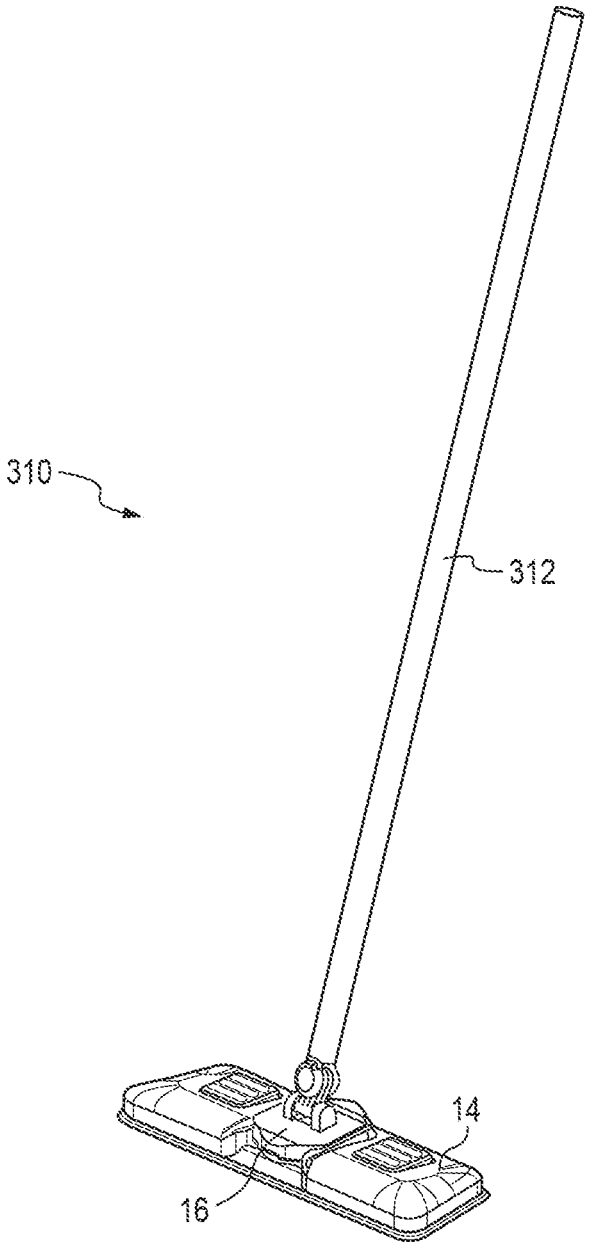
FIG. 8 is a perspective view of the front of an alternative embodiment of a mop with a removable secondary cleaning head.
Figure 9:
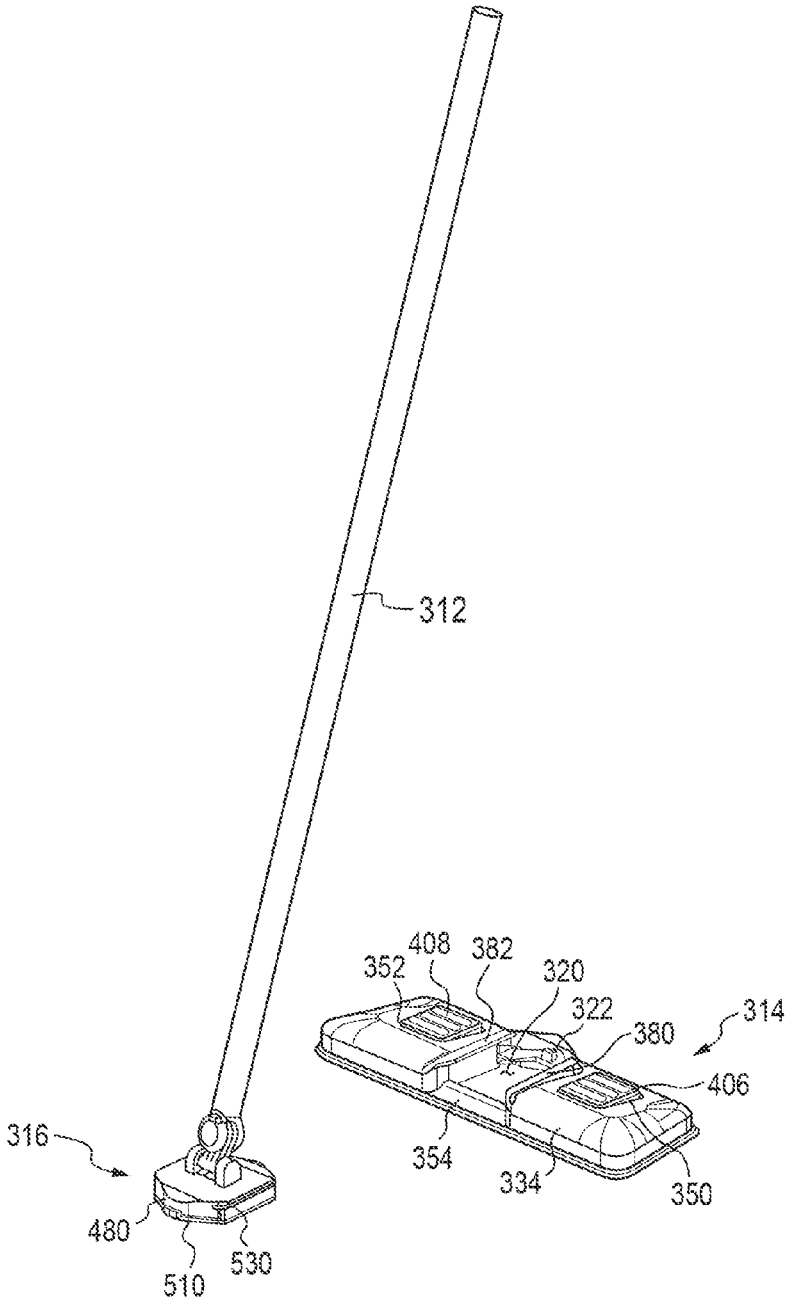
FIG. 9 is perspective view of the mop shown in FIG. 8 with the secondary cleaning head removed from a mop head.

FIGS. 8 and 9 depict an alternative embodiment of a mop 310 that is very similar to the mop 10 described above. FIGS. 8 and 9 depict a mop 310 including a handle 312, a mop head 314, and a secondary cleaning head 316. The handle 312 operatively connects with the mop head 314 through the secondary cleaning head 316. The mop 310 can be either a wet mop or a dry mop. The secondary cleaning head 316 is removable from the mop head 314, as depicted in FIG. 9. The mop head 314 includes a secondary cleaning head chamber 320 where the secondary cleaning head 316 resides when connected with the mop head 314. A first attachment element 322 on the mop head 314 engages with and can be disengaged from the secondary cleaning head 316 to connect and disconnect the secondary cleaning head with the mop head 314.

Similar to the mop head 14 described above, the mop head 314 also includes a ramp 354 that is positioned in front of and leads to the secondary cleaning head chamber 320. The mop head also includes tracks 380, 382 that cooperate with slots 530 (only one slot is visible in FIG. 9) in the secondary cleaning head 16 to appropriately orient the secondary cleaning head 316 within the secondary cleaning head chamber 320. The tracks 380, 382 and the slots 530 facilitate the connection between the secondary cleaning head 316 and the mop head 314.

The mop head 314 includes a latching mechanism, which includes a pedal similar to the pedal 38 described above, and springs (not visible). The latching mechanism also includes the first attachment element 322 that engages the secondary cleaning head 316 to retain the secondary cleaning head 316 within the secondary cleaning head chamber 320. In the embodiment depicted in FIGS. 8 and 9, the pedal is an integrally formed, e.g., molded, piece of plastic including the first attachment element 322 and an actuator, which are a pads 406 and 408. The actuator pads 406, 408 can be stepped on by an operator to unlatch the secondary cleaning head 316 from the first attachment element 322 so that the secondary cleaning head 316 can be slid out from the secondary cleaning head chamber 320 and disconnected from the mop head 314. The actuator pads 406, 408 are exposed through actuator pad opening 350 and 352, which are on opposite sides of the secondary cleaning head chamber 320 and extend through a housing 334 of the mop head 314, so as to be accessible by an operator of the mop 310 during a mopping operation. The pedal in the embodiment disclosed in FIGS. 8 and 9, similar to the pedal 38 described above, pivots about a pivot axis with respect to the housing 334.

Springs (not visible, but similar to the spring 104) act against a lower section of the housing 334 and the actuator pads 406, 408 to pivot the pedal in a general upward direction about the pivot axis. Since the first attachment element 322 is connected or formed with the actuator pads 406, 408, when an operator presses down on either actuator pad 406, 408 moving the actuator pads 406, 408 downwardly with respect to the housing 334, the first attachment element 322 also moves downwardly with respect to the housing 334.

The secondary cleaning head includes a body 480 (similar to the body 180) and a scrubbing pad 510 (similar to the scrubbing pad 210) releasably connected with the body 480. The secondary cleaning head 316 also includes a second attachment element that cooperates with the first attachment element 322 on the mop head 314. The second attachment element for the secondary cleaning head 316 can be an opening or recess (similar to the opening or recess 236) provided in a chamfered rear section of a lower surface of the body 380. The secondary cleaning head 316 connects with and disconnects from the mop head 314 in a similar manner to the mop 10 described above.

Examples of a mop with a removable secondary cleaning head have been described above with particularity. Modifications and alterations will occur to those upon reading and understanding the preceding detailed description. The invention is not limited to only the embodiments described above. Instead the invention is broadly defined by the appended claims and the equivalents thereof. It will be appreciated that various of the above-disclosed embodiments and other features, or alternatives or varieties thereof, may be desirably combined into many other different applications. Also that various presently unforeseen or unanticipated alternatives, modifications, variations or improvements therein may be subsequently made by those skilled in the art which are also intended to be encompassed by the following claims.

The invention claimed is:

1. A mop comprising:

a mop head including a secondary cleaning head chamber and a first attachment element, wherein the mop head includes a leading edge and a trailing edge, and the secondary cleaning head chamber is open at the leading edge;

a secondary cleaning head selectively receivable in the secondary cleaning head chamber and including a second attachment element that cooperates with the first attachment element to selectively connect the secondary cleaning head with the mop head, wherein the mop head and the secondary cleaning head chamber are configured such that the secondary cleaning head is slid over the leading edge toward the trailing edge to move the second attachment element toward the first attachment element so as to engage the second attachment element with the first attachment element;

a handle connected with the secondary cleaning head and operatively connectable to the mop head, wherein the handle is connected with the mop head when the secondary cleaning head is received in the secondary cleaning head chamber and the second attachment element is engaged with the first attachment element, and the handle is disconnected with the mop head when the secondary cleaning head is not received in the secondary cleaning head chamber; and a latching mechanism including the first attachment element, a spring biasing the first attachment element and a pad connected with the first attachment element, wherein the spring biases the first attachment element toward a latched position where the first attachment element is engaged with the second attachment element, and the pad is configured to be stepped on by an operator and when stepped on the first attachment element is moved toward a position where the first attachment element is not engaged with the second attachment element, wherein the mop head and the secondary cleaning head chamber are configured such that the secondary cleaning head is slid forwardly over the leading edge away from the operator and the trailing edge to remove the secondary cleaning head from the secondary cleaning head chamber when the second attachment element is not engaged with the first attachment element.

2. The mop of claim 1, wherein the handle is an elongated pole.

3. The mop of claim 1, wherein the mop head includes a ramp that is angled upwardly away from a surface to be cleaned by the mop and toward the secondary cleaning head chamber when the mop head is on the surface to be cleaned in an operating position.

4. The mop of claim 3, wherein the secondary cleaning head includes a lower surface having a chamfered section and the second attachment element includes an opening or recess provided in the secondary cleaning head.

5. The mop of claim 4, wherein the mop head includes one of a respective track and a respective slot on opposite sides of the secondary cleaning head chamber, and the secondary cleaning head includes the other of the respective track and the respective slot on opposite sides of the secondary cleaning head.

6. The mop of claim 1, wherein the secondary cleaning head includes a lower surface having a chamfered rear section and the second attachment element includes an opening or recess provided in the secondary cleaning head.

7. The mop of claim 6, wherein the first attachment element is biased so as to be received in the opening or recess when the secondary cleaning head is received in the secondary cleaning head chamber, and the first attachment element includes a ramped leading surface, wherein the chamfered rear section and the ramped leading surface are configured such that as the chamfered rear section contacts the ramped leading surface the first attachment element is moved downwardly until the first attachment element is received in the opening or the recess.

8. The mop of claim 1, wherein the first attachment element and the pad are part of an integrally formed piece of plastic.

9. The mop of claim 8, wherein the mop head includes a housing and the first attachment element and the pad are part of an integrally formed pedal that is pivotally connected with the housing.

10. The mop of claim 1, wherein the mop head includes an upper housing section and a lower housing section connected with the upper housing section, wherein the spring biases the first attachment element through a latch opening in the upper housing section.

11. The mop of claim 10, wherein the pad extends through an actuator pad opening provided in at least one of the upper housing and the lower housing.

12. A mop comprising:

a mop head including a secondary cleaning head chamber and a first attachment element, the secondary cleaning head chamber having a secondary cleaning head chamber floor;

a secondary cleaning head selectively receivable in the secondary cleaning head chamber and including a second attachment element that cooperates with the first attachment element to selectively connect the secondary cleaning head with the mop head;

a handle connected with the secondary cleaning head and operatively connectable to the mop head, wherein the handle is connected with the mop head when the secondary cleaning head is received in the secondary cleaning head chamber and the second attachment element is engaged with the first attachment element, and the handle is disconnected with the mop head when the secondary cleaning head is not received in the secondary cleaning head chamber;

a scrubbing pad connected with the secondary cleaning head; and a cleaning pad connected with the mop head, wherein the secondary cleaning head includes a lower surface that is at least partially covered by the scrubbing pad and the scrubbing pad is offset from the secondary cleaning head chamber floor so as to be exposed to ambient air when the secondary cleaning head is received in the secondary cleaning head chamber and the second attachment element is engaged with the first attachment element.

13. The mop of claim 12, wherein the mop head includes at least one of a track and a slot, and the secondary cleaning head includes the other of the track and the slot, wherein the slot receives the track when the secondary cleaning head is received in the secondary cleaning head chamber and the second attachment element is engaged with the first attachment element.

14. The mop of claim 13, wherein the mop head includes at least two tracks and the secondary cleaning head includes at least two slots, wherein each slot receives a respective track when the secondary cleaning head is received in the secondary cleaning head chamber and the second attachment element is engaged with the first attachment element.

15. The mop of claim 14, wherein the scrubbing pad is more abrasive than the cleaning pad.

* * * * *